US005134004A

United States Patent [19]

Moline

[11] Patent Number: 5,134,004

[45] Date of Patent: Jul. 28, 1992

[54] HIGH STRENGTH STAINED GLASS PANEL ASSEMBLY

[76] Inventor: Brian F. Moline, 1511 Birchlawn Pl., Ottawa, Ill. 61350

[21] Appl. No.: 669,684

[22] Filed: Mar. 14, 1991

[51] Int. Cl.[5] ..... B44F 3/00

[52] U.S. Cl. ..... 428/38; 52/311; 428/45; 428/58

[58] Field of Search ..... 428/38, 33, 45-58; 52/311

[56] References Cited

U.S. PATENT DOCUMENTS

| | | | |
|---|---|---|---|
| 317,077 | 5/1885 | Belcher | 428/38 |
| 3,547,766 | 12/1976 | Chu | 428/38 |
| 3,655,493 | 4/1972 | Campbell | 428/38 |
| 3,676,920 | 7/1972 | Pilditch | 428/38 X |
| 3,953,110 | 4/1976 | Charoudi | 428/38 X |
| 4,078,097 | 3/1978 | Miller | 427/34 |
| 4,110,393 | 8/1978 | Trame | 428/38 X |
| 4,172,547 | 10/1979 | DelGrande | 428/38 X |
| 4,194,669 | 3/1980 | Bromberg | 428/38 X |
| 4,252,847 | 2/1981 | Del Grande | 428/38 |
| 4,255,475 | 3/1981 | Del Grande | 428/38 X |
| 4,302,260 | 11/1981 | Meltzer | 428/38 X |
| 4,352,843 | 10/1982 | Eckert | 428/38 X |
| 4,610,901 | 9/1986 | Linscott | 428/38 |
| 4,904,513 | 2/1990 | De Nicolo | 428/38 X |
| 5,039,468 | 8/1991 | Sellers | 428/38 X |

*Primary Examiner*—Henry F. Epstein
*Attorney, Agent, or Firm*—Fleit, Jacobson, Cohn, Price, Holman & Stern

[57] ABSTRACT

A mosaic or stained glass panel assembly is provided including a rigid peripheral frame and at least one internal frame spine extending across the peripheral frame and having opposite ends securely anchored relative to remote portions of the peripheral frame. A plurality of decorative panel sections, placed in spaced relation, are positioned within the frame and spaced from the peripheral frame as well as the frame spine and the spacing between adjacent panel sections and the panel sections and the peripheral frame define spacing paths which are filled with beads of solidified low temperature melting metal or the like with beads of the metal overlying the marginal portions of the opposite side surfaces of the panel sections extending along the spacing paths and also encasing the peripheral frame therein.

6 Claims, 2 Drawing Sheets

HIGH STRENGTH STAINED GLASS PANEL ASSEMBLY

BACKGROUND OF THE INVENTION

1. Field of the Invention

This invention relates to a mosaic or stained glass panel assembly constructed in a manner to have high strength against flexure as compared to conventional mosaic or stained glass panel assemblies, which require bulky, large profile supporting frames. In addition, the panel assembly and method of making the same are such that pre-designed mosaic or stained panel assemblies may be mass produced at considerably lower costs than mosaic or stained glass panels constructed by conventional methods heretofore known.

2. Description of Related Art

Various different forms of mosaic or stained glass panel assemblies heretofore have been provided including some of the general aspects of the instant invention. Examples of these previously known forms of devices are disclosed in U.S. Pat. Nos. 317,077, 3,676,920, 4,078,097, 4,172,547 and 4,904,513. However, these previously known forms of panel assemblies do not include the overall combination of structural features of the instant invention, nor are they constructed by the same method.

Prior art has failed to provide sufficient self-contained autonomous internal and external reinforcement in decorative mosaic and stained glass panel assemblies. Therefore, these assemblies are basically fragile, without adequate resistance to flexing and bowing. Conventional procedures have relied on a peripheral frame such as wood, as in window type framing. Additionally, the panels require further strengthening by the addition of external steel rebar or similar reinforcement across and on top of the panel face, with the ends notched and secured to the peripheral frame. The result is an assembly that has some resistance to flexure and bowing, but only after semi-permanent installation into an existing space, such as a window frame. Thus, the major shortcoming of prior art is its inability to produce an autonomous, easy to handle, panel that is resistant to flex and bowing before installation, requiring almost permanent installation by a highly trained professional. This professional, generally the fabricating craftsperson, is therefore highly limited in the marketing area and economic reasons to engage in modern manufacturing methods.

SUMMARY OF THE INVENTION

The mosaic or stained glass panel assembly of the instant invention includes a rigid peripheral frame or of other material with strength such as steel, of any desired plan shape, and at least one rigid steel, or similar material, elongated edge upstanding internal frame spine extending across the rigid frame and including opposite ends fixedly anchored securely to remote peripheral portions of the frame. Within the frame a plurality of panel sections are disposed of predetermined shape and each pair of adjacent panel sections includes similarly contoured opposing marginal portions spaced slightly apart and the panel sections opposing adjacent marginal sections of the peripheral frame are slightly spaced therefrom and conform to the contour thereof. In this manner, communicating spacing paths ar disposed between pairs of adjacent panel sections and the panel sections adjacent opposing portions of the peripheral frame. The spine conforms to the contour of, is generally centered in and extends fully through one of these spacing paths and the panel assembly, during its manufacture, is disposed upon and supported from a heat resistant panel having grooves formed in its upper surface extending along and wider than all of the aforementioned spacing paths and beneath the peripheral frame. The marginal portions of the upper surfaces of the panel sections extending along the aforementioned spacing paths and the peripheral frame is coated with an intermediate coating such as copper powder (or other similarly functioning material) and the heat resistant panel with the components of the mosaic or stained glass panel assembly supported therefrom are evenly heated to a predetermined temperature, after which a heated, molten metal, such as lead or solder, is sprayed with an electrostatic charge from overhead nozzles, charged negatively, being pulled and attracted to a positive charge placed into the precoated peripheral frame, internal spines, and the peripheral metallic coating of the mosaic or stained glass, as the, yet to be joined, assembly units, positioned on the top surface of the aforementioned heat resistant, is conveyed under molten metal spray nozzle or nozzles. The copper powder intermediate coating and the electrical attraction of the molten spray selectively determines those surfaces, only, to which the molten metal adheres and the quantity of molten metal sprayed is such to ensure that all of the spacing paths and grooves in the heat resistant panel are filled and that the molten metal within the spacing paths overfills the latter so as to form a raised bead along each spacing path overlying the immediately adjacent margins of the upper surfaces of the panel sections.

The main object of this invention is to provide a mosaic or stained glass panel assembly of considerably greater strength than that associated with conventional panel assemblies to the extent that the panel assembly will strongly resist flexing and bowing. More specifically, this greater strength will allow the safe handling and placement of a finished panel assembly by a unskilled worker or enduser, without tools. Strongly tied to this ease of handling and placement is that the greatly improved strength allows shipment worldwide without any special or costly packing by common carriers such as parcel delivery, truck, rail or air. Not requiring permanent installation by a costly installation professional the greatly strengthened panel, being almost instantly removable, offers increased decorating options and since the panel is not permanently attached it is not considered a integral part of the structure it was installed on and becomes a piece of real personal property that can relocate with enduser or has value, autonomously, to be bartered or sold.

Almost as important as the main object of this invention, is to satisfy the aesthetic considerations as to placement and appearance of the improved panel as it sits within a existing space. Using a narrow profile peripheral frame presents a width no greater than the edge treatment of conventional panels before their installation in a heavier strengthening peripheral frame. The narrow peripheral frame, of this invention, when placed in position, gives the appearance that the strengthened panel is permanently glazed in panel of conventional construction.

Another object of this invention is to provide an improved mosaic or stained glass panel assembly including more uniformly formed solidified metal beads without extensive highly skilled hand labor.

Another very important object of this invention is to provide a mosaic or stained glass panel whose metal beads form a greatly improved bond between adjacent panel sections of the panel assembly and between the peripheral frame and the adjacent panel sections of the panel assembly.

Still another object of this invention is to provide an improved method of constructing a mosaic or stained glass panel incorporating steps which enable predesigned panel assemblies to be mass produced at a relatively low cost.

A final object of this invention to be specifically enumerated herein is to provide a mosaic or stained glass panel assembly in accordance with the preceding objects and which will conform to conventional forms of manufacture, be of simple construction and possess increased strength so as the provide a device that will be economically feasible, long-lasting and capable of withstanding greater lateral forces.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENT

Figure 1:
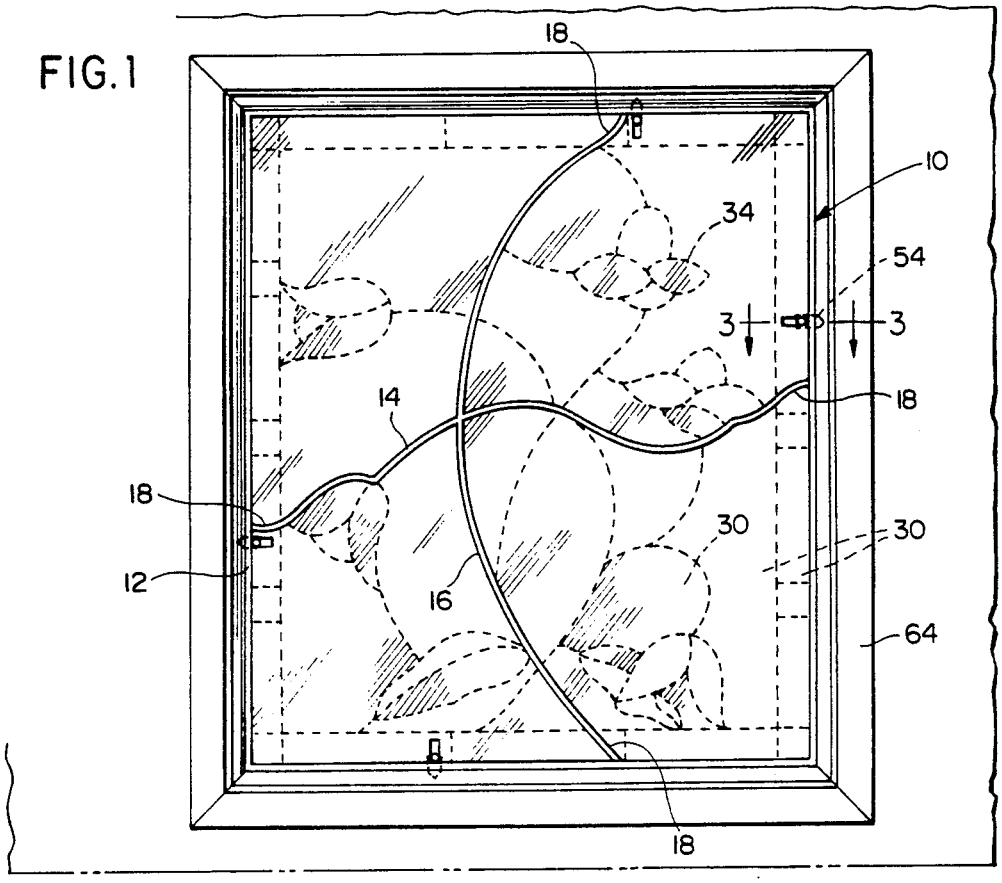
FIG. 1 is a front elevational view of the peripheral frame and reinforcing spine portions of the panel assembly of the instant invention mounted within a window opening up against a glass panel of the window opening, the individual panel sections and the connecting solidified metal beads of the panel assembly being omitted but with the ultimate design of the panel assembly illustrated in phantom lines.
Figure 6:
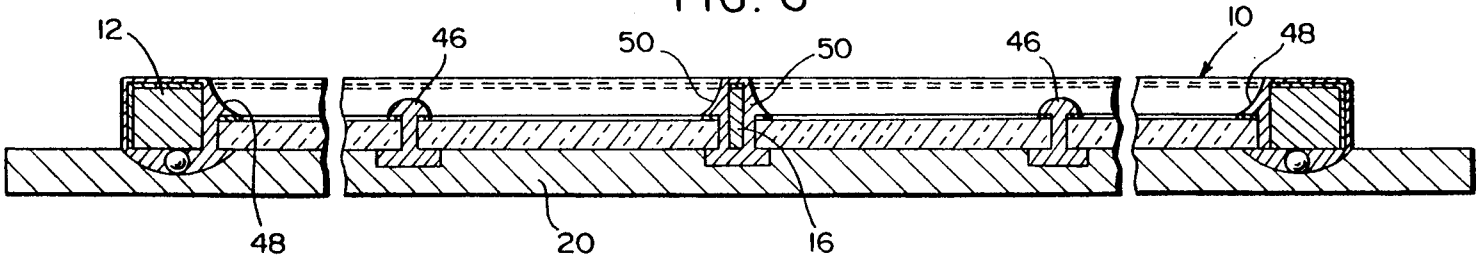
FIG. 6 is a vertical sectional similar to FIG. 5 but illustrating the panel assembly immediately subsequent to spraying heated molten metal thereon.

Referring now more specifically to the drawings and to FIG. 1 and 6 in particular, the reference numeral 10 generally designates a high strength mosaic or stained glass panel assembly constructed in accordance with the present invention. The panel assembly 10 includes a rigid peripheral frame 12 of any predetermined plan shape and one or more rigid, edge upstanding ribbon-type internal frame spines 14 and 16. The frame spines 14 and 6 cross each other and are downwardly and upwardly notched, respectively, at their intersection and rigidly secured together by welding or other suitable means. In addition, the spines 14 and 16 include opposite ends 18 which are rigidly secured to remote peripheral portions of the frame 12.

In order to construct the panel assembly 10, a heat resistant panel 20 is provided and a peripheral groove 22 in formed in the upper surface 24 thereof, the plan size and shape of the peripheral groove 22 conforming exactly to the plan shape and size of the peripheral frame 12. In addition, the upper surface 24 has additional communicating grooves 26 formed therein and at least some portions of the communicating grooves 26 open into the peripheral groove 22.

The peripheral frame 12, including the spines 14 and 16, is placed upon the heat resistant panel 20 with any suitable structures such as small zinc balls 28 disposed within the groove 22 to support the frame 12 from the panel 10 with the under surface of the frame 12 substantially co-planar with the upper surface 24 of the panel 20. Also, the spines 14 and 16 extend along and are substantially centered over corresponding portions of the communicating grooves 26.

Thereafter, a plurality of panel sections are placed upon the upper surface 24 within the confines of the frame 12 and with adjacent pairs of panel sections 30 being spaced apart and defining spacing paths 32 therebetween and between the inner peripheral portions of the frame 12 and opposing margins of the panel sections 30.

The spines 14 and 16 are centered in and conformed to the contour of the corresponding spacing paths 32. The panel sections 30 may be constructed of color tinted transparent material such as glass and are of predetermined plan shape so as to define, together, a predetermined design 34 of the completed panel assembly 10.

Thereafter, the top and outer surfaces of the peripheral frame 12, the top surfaces of the spines 14 and 16 and the marginal portions of the upper surfaces of the panel sections 30 extending along the spacing paths 32 are provided with copper powder intermediate coatings 36.

Figure 5:
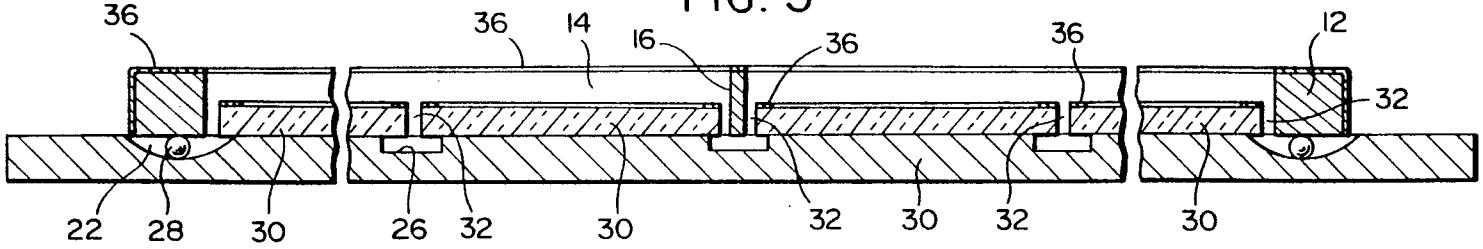
FIG. 5 is vertical sectional view similar to FIG. 4 but illustrating the various surfaces of the peripheral frame and panel sections coated with copper powder or similar functioning material immediately prior to spraying heated molten metal upon the panel assembly.

Thereafter, the assembly illustrated in FIG. 5 is placed within an oven 40 and heated to an extent slightly below the melting point of the metal to be used to coat the peripheral frame 12 and to fill the spacing paths 32 as well as the peripheral groove 22 and the connecting grooves 26. After this heating step has been accomplished, the heating assembly comprising the assembled components illustrated in FIG. 5 is passed beneath negatively charged spray heads 44 from which molten metal heated to a temperature slightly above the melting temperature thereof is sprayed downwardly upon the positively charged assembled components within the oven 40.

After a sufficient amount of molten metal (such as lead or solder) has been sprayed upon the assembled components within the oven 40, the assembled components with the molten metal spray thereon exits the oven 40 and is allowed to cool, afterwhich the panel assembly 10 and heat resistant panel 30 are readily separated. The copper powder previously applied enables the molten metal to form a bond with not only the peripheral frame 12 but also the top edges of the spines 14 and the marginal edges of the upper surfaces of the panel sections 30 bordering the spacing paths 32, the molten metal not otherwise bonding to the unpowdered portions of the panel sections 30 or bonding to the heat resistant panel 20. In addition, the molten metal fills the grooves 22 and 26 in the manner illustrated in FIG. 6 of the drawings and the surface tension of the molten metal enables the latter to solidify in manner forming raised beads 46 which overlie the adjacent margins of the upper surfaces of the panel sections 30 extending along the spacing paths 30. In addition, the molten metal forms radiused edges 48 between the inner periphery of the peripheral frame 12 and the adjacent margins of the upper surfaces of the adjacent panel sections 30 and also radiused edges 50 between those portions of the spines 16 extending above panel sections 30 and the adjacent margins of the upper surfaces of the adjacent panel sections 30. The upper side of the panel assembly illustrated in FIG. 6 may be considered as the rear side thereof and the side of the assembly 10 opposing the heat resistant panel 20 may be considered as the front side.

Figure 2:
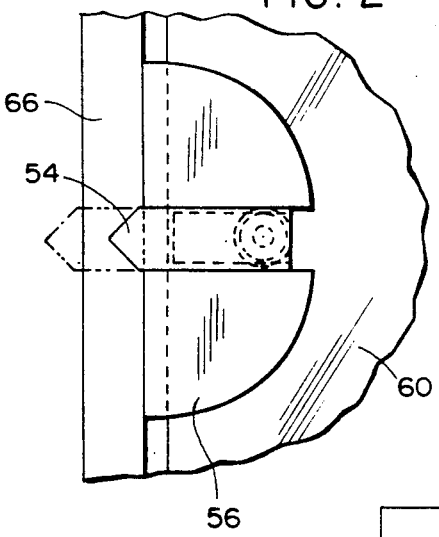
FIG. 2 is a fragmentary enlarged rear elevational view of a peripheral portion of the frame of the panel assembly illustrating one of the slidable blade-type mounting tangs of the panel assembly.
Figure 3:
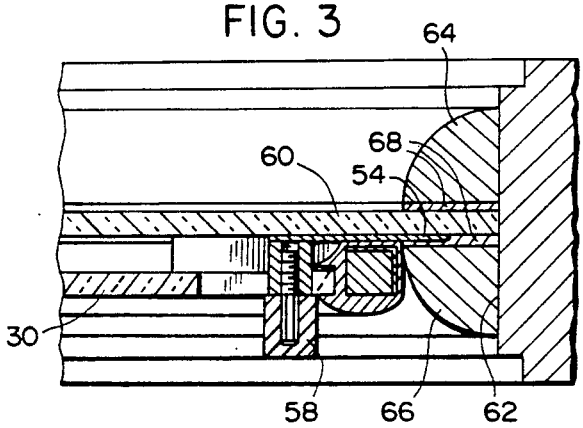
FIG. 3 is an enlarged fragmentary horizontal sectional view taken substantially upon the plane indicated by the section line 3—3 of FIG. 1.
Figure 7:
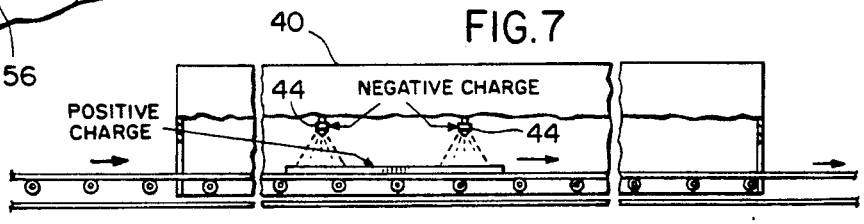
FIG. 7 is a schematic view illustrating the manner in which a support panel and preassembled mosaic or stained glass panel may be moved through a heating oven including negatively charged spray heads for downwardly spraying heated molten metal upon the positively charged panel assembly being formed.
Figure 4:
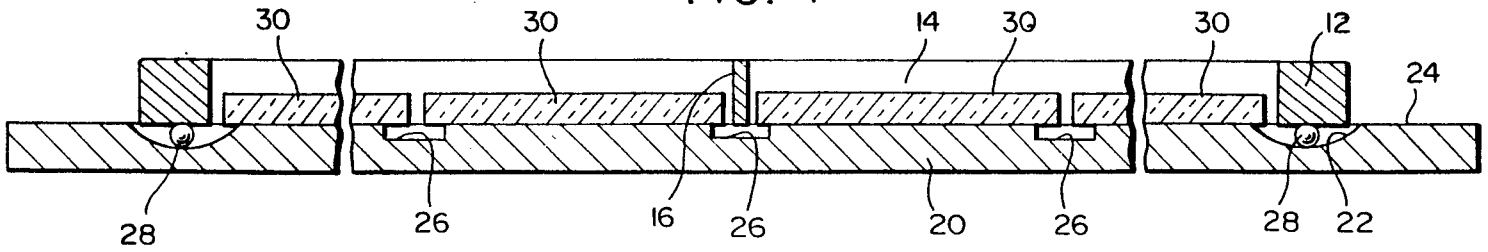
FIG. 4 is a vertical sectional view of all of the components of the panel assembly as initially supported from a grooved heat resistant support panel.

With attention now invited more specifically to FIGS. 1, 2 and 3 of the drawings, certain preselected portions of the peripheral frame 12 are provided with blade-type tangs 54 which are slidably supported from mounts 56 anchored relative to selected peripheral portions of the frame 12 and include clamp screws 58, see FIGS. 2 and 3.

When it is desired to mount the assembly 10 upon a window pane 60 mounted within an opening 62 through the utilization of opposite side molding pieces 64 and 66 in conjunction yieldable glazing 68, the assembly 10 is placed up against the inside of the window pane 60 in the manner illustrated in FIG. 3 of the drawings and the blade-type tangs 54 are outwardly extended relative to the corresponding peripheral portions of the frame 12 and embedded within the glazing 68 between the window pane 60 and the molding pieces 66. In this manner, the entirely assembly 10 may be supported in overlying relation relative to the inner surface of the window pane 60.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. A mosaic panel including a generally planar, horizontal and rigid peripheral frame and at least one elongated, ribbon-type and edge upstanding internal frame spine extending across said frame and including opposite ends fixedly anchored to remote peripheral portions of said frame, a plurality of horizontal, decorative panel sections of predetermined shape disposed within said peripheral frame in slight spaced apart relation with each pair of adjacent panel sections including similarly contoured opposing marginal portions and the marginal portions of said panel sections opposing adjacent marginal sections of said peripheral frame being spaced therefrom and conforming to the contour thereof, said internal frame spine extending across said frame through communicated spacing paths defined between successive pairs of adjacent opposing marginal portions of said panel sections and across further spacing paths defined between the spaced opposing marginal portions of said frame and adjacent panel sections in laterally spaced relation with adjacent panel section marginal portions, homogenous, integral and solidified metal bead sections filling said spacing paths, said bead sections including sections thereof encasing, totally, said internal frame spine therein as well as integral portions thereof overlying, completely, the marginal portions of both the upper and lower surfaces of said panel sections extending along said spacing paths.

2. The mosaic panel of claim 1 wherein said bead sections extending along said peripheral frame totally enclose the adjacent portions of said peripheral frame therein.

3. The mosaic panel of claim 1 wherein said solidified metal comprises solder.

4. The mosaic panel of claim 1 wherein aid peripheral frame includes blade-type tangs shiftably supported therefrom for adjustable positioning inward and outward of selected peripherally spaced outer portions of said frame, said blade-type tangs being generally co-planar with each other and one side of said frame, said tangs and frame including coacting means operative to releasably retain said tangs in outward shifted positions relative to said frame.

5. The mosaic panel of claim 1 wherein said panel sections comprise panels of color tinted transparent material.

6. The mosaic panel of claim 5 wherein said transparent material comprises glass.

* * * * *